US005355191A

United States Patent [19]

Nakamura et al.

[11] Patent Number: 5,355,191

[45] Date of Patent: Oct. 11, 1994

[54] PHOTOGRAPHIC PROCESSING APPARATUS AND METHOD

[75] Inventors: Takashi Nakamura; Yasuhisa Ogawa; Osami Tsuzi; Takeshi Nakamura, all of Kanagawa, Japan

[73] Assignee: Fuji Photo Film Co., Ltd., Kanagawa, Japan

[21] Appl. No.: 127,996

[22] Filed: Sep. 28, 1993

[30] Foreign Application Priority Data

Sep. 30, 1992 [JP] Japan ..... 4-285437

[51] Int. Cl.[5] ..... G03D 3/02

[52] U.S. Cl. ..... 354/324

[58] Field of Search ..... 354/324, 298, 299; 134/64 R, 64 P, 122 P, 122 R; 430/393, 398, 399, 400; 204/182.3, 182.4, 109

[56] References Cited

U.S. PATENT DOCUMENTS 4,089,760 3/1978 Ono ..... 204/109
4,145,271 3/1979 Nosse et al. ..... 204/180 P
4,217,188 8/1980 Ono ..... 204/109
4,313,808 2/1982 Idemoto et al. ..... 204/108 P
5,118,595 6/1992 Ishikawa ..... 430/399
5,298,371 3/1994 Nakamura ..... 430/393

*Primary Examiner*—D. Rutledge
*Attorney, Agent, or Firm*—Sughrue, Mion, Zinn, Macpeak & Seas

[57] ABSTRACT

A processing solution such as a developer and fixer is maintained at optimum processing ability by conducting electricity through an anion exchange membrane. In FIG. 1, for example, an anion exchange membrane A1 and an only $H^+$ and/or $OH^-$ permeable diaphragm M1 are disposed in a tank 11 to define three compartments 11*a*, 11*b*, 11*c* which are charged with electrolyte solution E1, developer Dev, and electrolyte solution E2 and have disposed therein anode 22, cathode 21 and anode 24, respectively. Silver halide photosensitive material is processed by passing it through the developer. Electricity is conducted between anode 22 and cathode 21 during processing and between anode 24 and cathode 21 during quiescent periods.

11 Claims, 3 Drawing Sheets

PHOTOGRAPHIC PROCESSING APPARATUS AND METHOD

BACKGROUND OF THE INVENTION

1. Field of the Invention

This invention relates to a photographic processing apparatus and method for processing photographic silver halide photosensitive material (often abbreviated herein as "photosensitive material").

2. Prior Art

Black-and-white photosensitive materials after exposure are processed through a series of steps including black-and-white development, fixation and washing and color photosensitive materials after exposure are processed through a series of steps including color development, desilvering, washing and stabilization. There are used black-and-white developer for black-and-white development, fixer for fixation, color developer for color development, bleaching, blix and fixing solutions for desilvering, city water or deionized water for washing, and stabilizer for stabilization. Photosensitive materials are generally processed by dipping them in the respective solutions which are normally adjusted to a temperature of 20°to 50° C.

Among these steps, the developing step is a step wherein a developing agent which is a reducing agent acts on exposed silver halide grains in the photographic emulsion for reducing $Ag^+$ into Ag. Silver images are created in this way in black-and-white photography. In the case of color photography, an oxidant of color developing agent reacts with a coupler to form a dye image corresponding to the silver image. The developers experience a lowering of developing power due to deterioration by conversion of the developing agent into an oxidant with the progress of processing and by air oxidation of the developing agent and preservative during quiescent periods.

For avoiding such developer deterioration, a typical prior art approach is to replenish an increased amount of developer. Increased replenishment, however, results in increased usage of chemical agents and water, which is undesirable particularly from the standpoint of environmental protection requiring resource saving and waste liquid reduction. Further, since color developing agents are expensive, their increased consumption is against economy.

More often than not, the developing agents are organic compounds in both black-and-white photography and color photography. Developers containing organic developing agents undesirably cause silver stains with the progress of processing of photosensitive material probably because sulfites used as the preservative form silver sulfite with silver halide dissolved from the photosensitive material. This might be overcome by increasing the replenishment amount, which is undesirable from the standpoint of environmental protection as mentioned above.

As is also well known, metal compounds having reducing ability to exposed silver halide grains are effective for black-and-white developers. Such useful metal compounds include salts and complexes of transition metals such as vanadium, titanium, iron and chromium as disclosed in Journal of Japan Photography, 20 (2), 62 (1957); ibid., 19, 40 (1956), ibid. 29, 31 (1966), Photographic Industry, March, 67 (1976), Journal of the Japanese Chemical Society, No. 9, 1321 (1980), PSE, 19, 283 (1975), Japanese Patent Publication (JP-B) No. 41899/1979, Chiba University Engineering Faculty Technical Report, 14, 1 (1962), ibid., 21 (40), 169 (1970), ibid. 18, 39 (1967), ibid., 21 (39), 11 (1970), Japanese Patent Application Kokai (JP-A) No. 51731/1975, U.S. Pat. No. 3,942,985 and 3,938,978, UKP 1,462,972, JP-A 78534/1982, PSE, 12 (6), 288 (1968), and PSE, 14 (6), 391 (1970).

As compared with the organic developing agents, these metal compounds have the advantage that they can be used in acidic or neutral aqueous solutions at higher concentrations without incurring silver stains, but the disadvantage that the developers associated therewith change their oxidation reduction potential with the lapse of time or with the progress of development reaction, failing to maintain a stable activity level. Such a disadvantage can be overcome by increasing the replenishment amount as in the case of organic developing agents at the sacrifice of resource saving and waste liquid reduction.

On the other hand, fixation is to dissolve away the residual silver halide with a suitable dissolving agent for fixing a developed silver image in the case of black-and-white photography. In the case of color photography, silver halide resulting from oxidation of an unnecessary silver image is dissolved away in the bleaching step.

Therefore, the fixer contains a fixing agent which is a silver halide dissolving agent and a preservative. During quiescent periods, the fixing agent and preservative are subject to air oxidation with the lapse of time and on oxidation, they decompose to form sulfides which incur sulfide troubles such as staining of photosensitive material surface. When the fixing agent used is hypo, for example, silver thiosulfate would accumulate in the fixer during processing. Under-fixation or short desilvering would occur unless a fresh fixing solution is replenished in a sufficient amount to reduce the silver thiosulfate concentration in the fixer. In the case of color photography, the above-mentioned troubles due to oxidation are aggravated by entrainment of bleaching solution by photosensitive material.

A typical prior art solution to this problem is to increase the amount of fixer replenished in both black-and-white photography and color photography. Increased replenishment, however, is undesirable from the standpoints of resource saving and waste liquid treatment as previously mentioned.

Under the circumstances, we previously proposed in U.S. Ser. No. 07/730,719 (filed Jul. 16, 1991) or JP-A 273237/1991 a method for treatment of a developer containing an organic developing agent or a fixer by placing it in contact with an electrolyte solution through an anion exchange membrane, immersing a cathode in the developer or fixer and an anode in the electrolyte solution, and conducting electricity between the electrodes. With respect to a developer containing a metal compound as the developing agent, we previously proposed in Japanese Patent Application No. 24137/1991 a similar method of treating the developer by electric conduction.

These methods can treat the developer or fixer in a reducing atmosphere and remove $Br^-$ and other halide ions accumulating during processing by causing them to migrate from the developer or fixer to the electrolyte solution. This can advantageously maintain the development or fixation ability and is thus effective for reducing the replenishment amount.

One problem associated with these methods is that if electric conduction is made in the developer in order to prevent development ability lowering due to air oxidation during quiescent periods, then the developer is removed of $Br^-$ excessively and becomes more likely to fog. When the fixer is treated by the electric conduction method mentioned above, desilvering is short with some types of photosensitive materials, especially black-and-white photosensitive materials and plate-making photosensitive materials such as lithographic photosensitive materials. There is a need for a further reduction in replenishment amount.

In addition, the anion exchange membrane loses its processing ability during an extended period of use, that is, has a short life, especially with color developers containing higher contents of organic developing agents.

SUMMARY OF THE INVENTION

A primary object of the present invention is to provide a photographic processing apparatus and method which can maintain the processing ability of a developer and fixer high enough to reduce the replenishment amount and which are thus advantageous for environmental protection.

A second object of the present invention is to provide a photographic processing apparatus and method of maintaining the processing ability of a processing solution by electric conduction through an anion exchange membrane, which can extend the life of the anion exchange membrane.

The present invention is directed to an apparatus for processing a photographic silver halide photosensitive material after exposure, comprising a tank having disposed therein an anion exchange membrane and a diaphragm impermeable to anions excluding at least $OH^-$. The tank is charged with a processing solution in contact with a first electrolyte solution through the anion exchange membrane and in contact with a second electrolyte solution through the diaphragm.

According to a first aspect, a first anode is immersed in the first electrolyte solution, a second anode immersed in the second electrolyte solution, and a cathode immersed in the processing solution. There is provided means for conducting electricity between the anodes and the cathode. Preferably the conducting means includes a control for independently conducting electricity between a selected pair of electrodes. A photographic processing method using this apparatus includes the step of conducting electricity across at least one of a first combination of the first anode and the cathode and a second combination of the second anode and the cathode in response to processing of photosensitive material. Preferably, electricity is conducted between the first pair of electrodes in accordance with the quantity of photosensitive material processed, and electricity is conducted between the second pair of electrodes in accordance with the elapsed time. Further preferably, electricity is conducted between the first and second pairs of electrodes in accordance with the quantity of photosensitive material processed.

According to a second aspect, an anode is immersed in the first electrolyte solution, a first cathode immersed in the processing solution, and a second cathode immersed in the second electrolyte solution. There is provided means for conducting electricity between the anode and the cathodes. Preferably the conducting means includes a control for independently conducting electricity between a selected pair of electrodes. A photographic processing method using this apparatus includes the step of conducting electricity across at least one of a first combination of the anode and the first cathode and a second combination of the anode and the second cathode in response to processing of photosensitive material. Preferably, electricity is conducted between the second pair of electrodes primarily in accordance with the quantity of photosensitive material processed, and electricity is conducted between the first pair of electrodes in accordance with the elapsed time and the quantity of photosensitive material processed.

Also contemplated herein is an automatic developing machine for processing a photographic silver halide photosensitive material after exposure, including at least a processing vessel filled with a processing solution with which the photosensitive material is processed. The machine is combined with the apparatus of the first or second aspect wherein the vessel and the tank are coupled through a conduit for communication of the processing solution therebetween. Differently stated, the machine has incorporated therein the apparatus of the first or second aspect such that the processing solution in the tank is in fluid communication with the processing solution in the processing vessel.

In a preferred embodiment, an anode is immersed in the first electrolyte solution and a cathode immersed in the second electrolyte solution. There is provided means for conducting electricity between the anode and the cathode. A photographic processing method using this apparatus includes the step of conducting electricity between the anode and the cathode in response to processing of photosensitive material.

In all these embodiments, the processing solution is a developer or a fixer.

BRIEF DESCRIPTION OF THE DRAWINGS

These and other objects and advantages of the present invention will be better understood by reading the following description taken in conjunction with the accompanying drawings.

DETAILED DESCRIPTION OF THE PREFERRED EMBODIMENTS

The photographic processing apparatus according to the invention includes a processing tank in which disposed are an anion exchange membrane and a diaphragm impermeable to anions excluding at least $OH^-$, typically a cation exchange membrane or an only $H^+$ and/or $OH^-$ permeable diaphragm as well as electric conduction means. According to the photographic processing method of the invention, photographic silver halide photosensitive material is passed through the processing solution for processing while effecting electric conduction. The term "electric conduction" used herein generally means the phenomenon that electricity is externally applied to electrodes in electrolyte solution to promote reaction or electrolysis between the electrodes and the electrolyte solution and at the same time, to induce ionic mass transfer through the membrane. In some cases, electric conduction means the phenomenon that only ionic mass transfer takes place.

Electric conduction appropriate for a particular state of processing solution can be done by properly placing one or more cathodes and one or more anodes and conducting electricity across a selected electrode pair. The processing solution used herein includes a developer, fixer and any other solution which recovers its ability through reduction. By selecting a proper membrane combination and a proper electrode pair and effecting electric conduction, the processing ability of any processing solution can be maintained or recovered, for example, through migration of halide ions such as $Br^-$ or migration of alkali metal ions such as $K^+$. In one embodiment wherein the electrode (cathode) is immersed in a processing solution, the processing ability of the solution can be recovered by reduction. This permits the processing solution to be replenished in a reduced quantity.

In another embodiment wherein the electrode (cathode) is not immersed in a processing solution, the life of the anion exchange membrane is extended as compared with electric conduction solely with the anion exchange membrane. Since the anion exchange membrane is less resistant against an electric field associated with the cathode, the present invention using another membrane in addition to the anion exchange membrane avoids the arrangement of the anion exchange membrane intervening between an anode and a cathode and thus mitigates the influence of a cathodic electric field. Accordingly the processing ability of the solution is effectively maintained or recovered.

Figure 1:
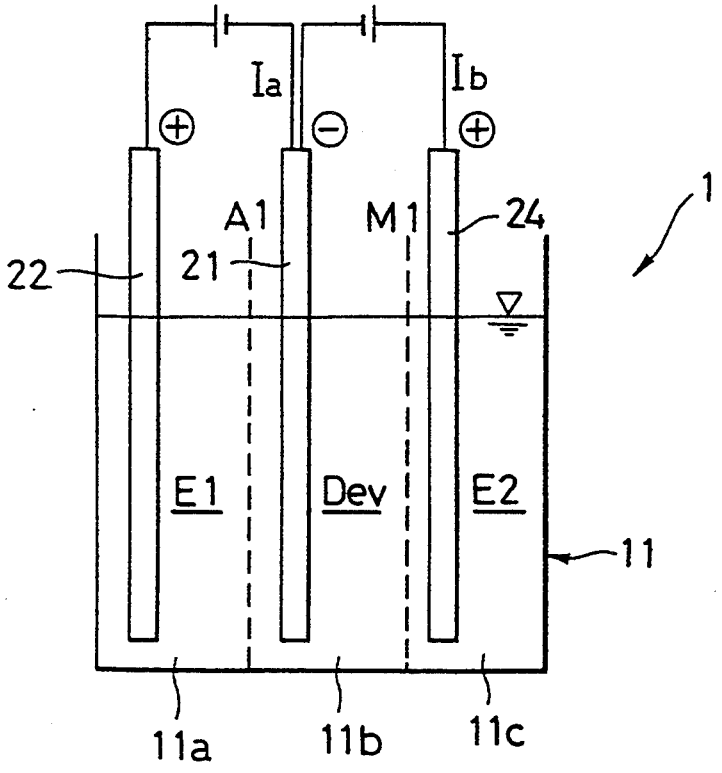
FIG. 1 is a schematic illustration of a photographic processing apparatus according to a first embodiment of the invention.

Referring to FIG. 1, there is illustrated one exemplary processing tank applicable to the photographic processing apparatus of the present invention.

The processing tank 1 shown in FIG. 1 is a developing tank for developing black-and-white photosensitive material. The processing tank 1 includes a trough 11, an anion exchange membrane A1 and a diaphragm M1 which allows passage of only $H^+$ and/or $OH^-$ ions. The membrane A1 and diaphragm M1 are disposed in the trough 11 so as to define three compartments 11*a*, 11*b*, and 11*c* with the trough walls.

Among the three compartments 11*a*, 11*b*, and 11*c*, the intermediate compartment 11*b* defined between the anion exchange membrane A1 and the diaphragm M1 is filled with a developer Dev in which a cathode 21 is immersed. The developer Dev is an inorganic developer containing a developing agent in the form of a metal compound capable of reducing an exposed silver halide. Photosensitive material is processed with this developer Dev.

The compartment 11*a* is filled with a first electrolyte solution E1 in contact with the developer Dev through the anion exchange membrane A1. A first anode 22 is immersed in the electrolyte solution E1. The compartment 11*c* is filled with a second electrolyte solution E2 in contact with the developer Dev through the diaphragm M1. A second anode 24 is immersed in the electrolyte solution E2. There is provided means for conducting electricity between the cathode 21 and the anodes 22, 24 in an appropriate combination. More particularly, electricity is conducted across a pair or two pairs of selected electrodes, that is, a combination (Ia) of anode 22 and cathode 21 and/or a combination (Ib) of cathode 21 and anode 24. In the illustrated embodiment, a DC source is connected across each electrode pair.

In the arrangement of FIG. 1, electric conduction is started at the same time or after the lapse of a certain time from the receipt of a signal indicative of the start of processing of photosensitive material. Electric conduction may also be started prior to photographic processing.

Preferably, electric conduction is continued during photographic processing because development activity is thereby maintained throughout the photographic processing. Electric conduction may be interrupted upon completion of photographic processing, for example, upon receipt of a signal indicative of the completion of processing of photosensitive material.

It is preferred to conduct electricity during quiescent (non-processing) periods too, with a proper choice being made among the combinations Ia and Ib. Preferably, electricity is conducted across combination Ia during processing periods and across combination Ib during quiescent periods.

Electric conduction may be achieved by applying voltage so as to provide a current density of 0.01 to 20 $A/dm^2$, preferably 0.1 to 4 $A/dm^2$. The applied voltage generally ranges from 0.05 to 100 V, preferably from 0.1 to 10 V although it varies with the solutions used, processing tank configuration, electrode-to-electrode distance, and properties and type of the diaphragm.

In the developing tank of the arrangement shown in FIG. 1, the metal compound contained as the developing agent in the developer can be converted into compounds of metal in higher oxidation state during development processing of photosensitive material or due to air oxidation during quiescent periods. Electric conduction across combination Ia or Ib as mentioned above causes the once oxidized metal compounds to be reduced on the electrode surface, thereby maintaining development activity in a stable manner during development processing.

At the same time, electric conduction across combination Ia also causes halide ions such as $Br^-$ which have been formed by development processing to migrate into the electrolyte solution E1 through the anion exchange membrane A1, thereby preventing accumulation of such ions in the developer Dev and thus preventing such ions from impeding development. On the other hand, electric conduction across combination Ib does not induce migration of $Br^-$ or anions.

Therefore, either electric conduction across combination Ia or Ib may be selected depending on the concentration of $Br^-$ in the developer Dev, with electric conduction across combination Ib being preferred during quiescent periods when there is no leaching of $Br^-$ ions from photosensitive material. This ensures that the $Br^-$ concentration of the developer Dev is always maintained at optimum, avoiding occurrence of fog.

The processing tank of the arrangement shown in FIG. 1 is also applicable to a developing tank filled with an organic developer. Advantageously, not only the same benefits as with the above-mentioned inorganic developer are obtained, but also silver staining can be inhibited by causing silver to precipitate on the cathode.

Where the processing tank of FIG. 1 is applied to a developing tank, the only $H^+$ and/or $OH^-$ permeable diaphragm M1 may be replaced by a cation exchange membrane with equivalent results.

Also the processing tank of FIG. 1 is applicable to a fixing tank insofar as its system is devoid of the problem of retarded fixation by $K^+$ or the like. Herein, either electric conduction across combination Ia or Ib may be selected depending on the concentration of $Br^-$ or the like in the fixer. Fixing capability is recovered by electric conduction.

It is to be understood that the electrolyte solutions E1 and E2 may be of the same or different types.

Figure 2:
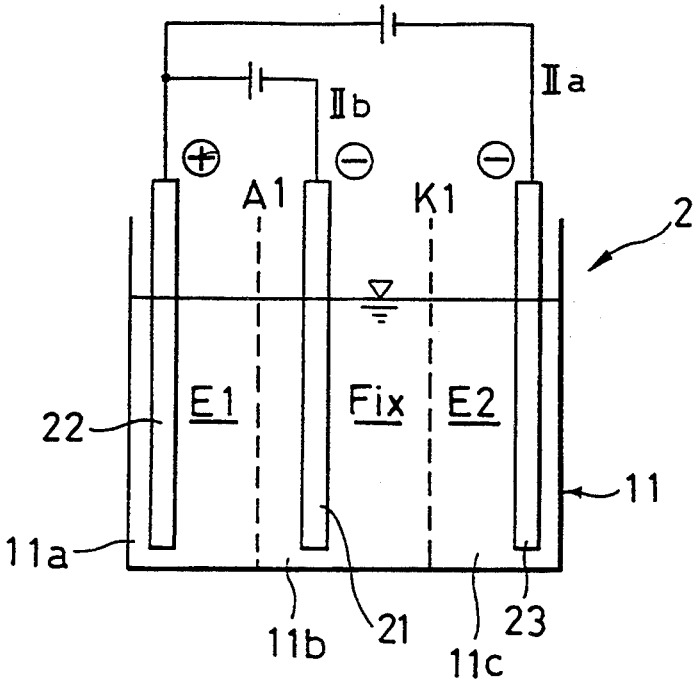
FIG. 2 is a schematic illustration of a photographic processing apparatus according to a second embodiment of the invention.

Another processing tank to which the photographic processing apparatus of the invention is applicable is shown in FIG. 2. The processing tank 2 shown in FIG. 2 is a fixing tank for fixing black-and-white photosensitive materials, for example, plate-making photosensitive materials, typically lithographic plate-making photosensitive materials. This tank is of substantially the same arrangement as in FIG. 1 except that the only $H^+$ and/or $OH^-$ permeable diaphragm M1 is replaced by a cation exchange membrane K1, the compartment 11*b* is filled with a fixer Fix, and a cathode 23 is disposed in the compartment 11*c*. There is also provided means for conducting electricity across either one or both of a combination IIa of the cathode 23 and the anode 22 and a combination IIb of the cathode 21 and the anode 22.

The arrangement of FIG. 2 favors electric conduction during processing while a proper choice may be made among the electrode pair combinations IIa and IIb. For example, the duration of electric conduction across combinations IIa and IIb may be determined in accordance with the quantity of photosensitive material to be processed. Alternatively, electric conduction is made across combination IIa during processing of photosensitive material and electric conduction across combination IIb can be made at predetermined intervals independent of whether or not photosensitive material is being processed. Such a choice may be made by considering the type of photosensitive material and processing conditions.

In the fixing tank of the arrangement shown in FIG. 2, electric conduction across combination IIa causes halide ions, which are detrimental to fixation, to migrate into the electrolyte solution E1, and at the same time, cations such as $K^+$ to migrate into the electrolyte solution E2. That is, any deleterious ions are removed from the fixer Fix. Removal of cations is preferred because such cations considerably restrain fixing of black-and-white photosensitive materials, for example, plate-making photosensitive materials, typically lithographic plate-making photosensitive materials. Also electric conduction across combination IIb causes the fixing agent to be directly reduced at the cathode surface and causes silver to deposit on the cathode so that silver is removed from the fixer, resulting in improved recovery of fixing capability. Formation of sulfides from the fixing agent and deterioration of preservatives are also avoided.

Although the processing tank of the arrangement shown in FIG. 2 is preferably applied to black-and-white photosensitive material fixing tanks, it can also be applied to color photosensitive material fixing tanks with equivalent results. It can also be a developing tank filled with either an organic developer or an inorganic developer, with equivalent results to those of the arrangement of FIG. 1. In this case too, it is preferred to suitably select the times of electric conduction across combinations IIa and IIb.

It is to be understood that where the processing tank of FIG. 2 is a developing tank or a fixing tank filled with a fixer which is relatively free of the problem of retarded fixation by cations such as $K^+$, the cation exchange membrane K1 may be replaced by an only $H^+$ and/or $OH^-$ permeable diaphragm.

Figure 3:
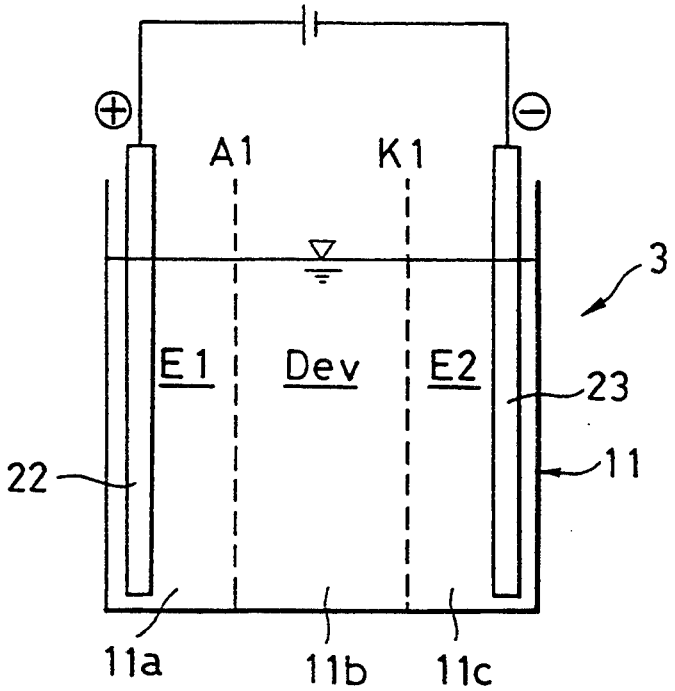
FIG. 3 is a schematic illustration of a photographic processing apparatus according to a third embodiment of the invention.

A still further processing tank to which the photographic processing apparatus of the invention is applicable is shown in FIG. 3. The processing tank 3 shown in FIG. 3 is a developing tank for developing color photosensitive materials. This tank is of substantially the same arrangement as in FIG. 2 except that the compartment 11*b* is filled with a color developer Dev, an anode 22 is disposed in the compartment 11*a*, and a cathode 23 is disposed in the compartment 11*c*. There is provided means for conducting electricity between the anode 22 and the cathode 23. The remaining components are the same as in the arrangement of FIG. 1.

In the arrangement of FIG. 3, electricity is preferably conducted during processing. Electric conduction causes halide ions such as $Br^-$, which have been formed during development processing, to migrate into the electrolyte solution E1 through the anion exchange membrane A1, thereby preventing accumulation of such ions in the developer Dev and thus preventing such ions from impeding development. At the same time as halide ions migrate, cations such as $K^+$ migrate from the developer Dev to the electrolyte solution E2 through the cation exchange membrane K1, but migration of such cations entails no loss of developing ability.

Since the cathode 23 is disposed in the compartment 11*c*, the developer Dev experiences no rise of pH because water is reduced at the cathode surface to produce $OH^-$. Although it is necessary to replenish a developing replenisher at higher pH, pH adjustment is relatively easy because the pH does not depend on electric conduction. The arrangement of FIG. 3 is also effective for preventing decomposition of a hydroxylamine hydrogensulfate preservative if any and preventing generation of ammonia gas and hence, fogging by ammonia gas.

Unlike the arrangement wherein a cathode is disposed adjacent an anion exchange membrane as described in JP-A 273237/1991, the arrangement of FIG. 3 wherein the cation exchange membrane K1 intervenes between the cathode and the anion exchange membrane is effective for extending the life of the anion exchange membrane A1 by virtue of reduced influence of the cathodic electric field.

Because of the extended life of the anion exchange membrane, the processing tank 3 of FIG. 3 is advantageously applied to a color developer although it may also be applied to a rinse solution.

The arrangement of various membranes including the anion exchange membrane and electrodes is not limited to the illustrated ones. For example, the arrangement of FIG. 1 may be modified by furnishing a pair of rod-shaped anodes and a cathode, disposing an anion exchange membrane in cylindrical form so as to enclose one anode, filling the cylindrical membrane interior with an electrolyte solution, and similarly, disposing a only $H^+$ and/or $OH^-$ permeable diaphragm in cylindrical form so as to enclose the other anode, and filling the cylindrical diaphragm interior with an electrolyte solution. This embodiment may be further modified by furnishing an additional anode, and disposing an only $H^+$ and/or $OH^-$ permeable diaphragm or anion exchange membrane in cylindrical form so as to enclose the additional anode. Similar modifications can be made to the arrangements of FIGS. 2 and 3.

As used herein, the cathode may be made of any of electric conductors and semiconductors which withstand long term operation, with stainless steel especially preferred. The anode may be made of any of insoluble electroconductive materials, for example, carbon (graphite), lead dioxide, platinum, gold, titanium and steel, and if desired, stainless steel. These electrodes are preferably configured to flat, meshed or bossed plates which are easy to dispose in the tank, and dimensioned in accordance with the volume of the tank.

The anion exchange membrane used herein may be any of membranes which allow selective passage of anions. Commercially available ones may be used as such. In particular, the anion exchange membrane may be selected depending on the valence of an anion which is desired to migrate through the membrane. For example, for the purpose of immigrating halide ions such as $Br^-$ which will accumulate in the developer, an anion exchange membrane which allows selective passage of only monovalent anions may be used.

For anions in general, anion exchange membranes are commercially available under the trade names of Selemion AMV/AMR (manufactured by Asahi Glass K.K.), Aciplex A201 and A172 (manufactured by Asahi Chemicals K.K.), Neosepta AM-1 to AM-3 (manufactured by Tokuyama Soda K.K.), Ionac MA-3148 (Ionac Chemicals K.K.), and Nepton AR 103PZL (Ionics K.K.). For the selective passage of monovalent anions, there are membranes commercially available in the trade names of Selmion ASV/ASR (manufactured by Asahi Glass K.K.) and Neosepta AFN-7 and ACS (manufactured by Tokuyama Soda K.K.).

As used herein, the anion exchange membrane is intended to encompass all membranes which allow selective passage of anions, and in this sense, porous ceramics having a pore diameter of 0.2 to 20 $\mu$m are included therein.

The cation exchange membrane used herein may be any of membranes which allow selective passage of cations, especially monovalent cations like $K^+$. Commercially available ones may be used as such. There are known membranes commercially available in the trade names of Neosepta CL-25T, CM-1, CM-2 and CMX (manufactured by Tokuyama Soda K.K.), Selmion CMV (manufactured by Asahi Glass K.K.) and Aciplex CK-1, CK-2 and K-101 (manufactured by Asahi Chemicals K.K.).

The only $H^+$ and/or $OH^-$ permeable diaphragm used herein may be any of electroconductive diaphragms which prohibit passage of anions and cations other than proton and hydroxyl ion. Commercially available ones may be used as such. There are known diaphragms commercially available in the trade names of Permasep B-15 (E.I. dupont), ZF99 (PCI), PEC-100, Su-210 and Su-410 (Toray K.K.), NTR-7250 and NTR-7197 (Nitto Denko K.K.), PBIL (Teijin K.K.), and NF-40 and NF-40HF (Film Tec.).

As used herein, the electrolyte solutions are not critical. Preferred examples of the electrolyte include halides such as NaCl, KCl, LiCl, NaBr, KBr, and KI, sulfates such as $Na_2SO_4$ and $K_2SO_4$, nitrates such as $KNO_3$, $NaNO_3$ and $NH_4NO_3$, and carbonates such as $Na_2CO_3$ and $K_2CO_3$. The electrolyte solution may contain such an electrolyte in a concentration of 0.01 to 30%, preferably 0.01 to 20% by weight. Alternatively overflow of the processing solution may be used with or without dilution.

Often the processing solutions contain electroconductive materials and the photosensitive material to be processed itself has electroconductivity. The present invention requires new provision of electrode members separate from such conductive components.

Figure 4:
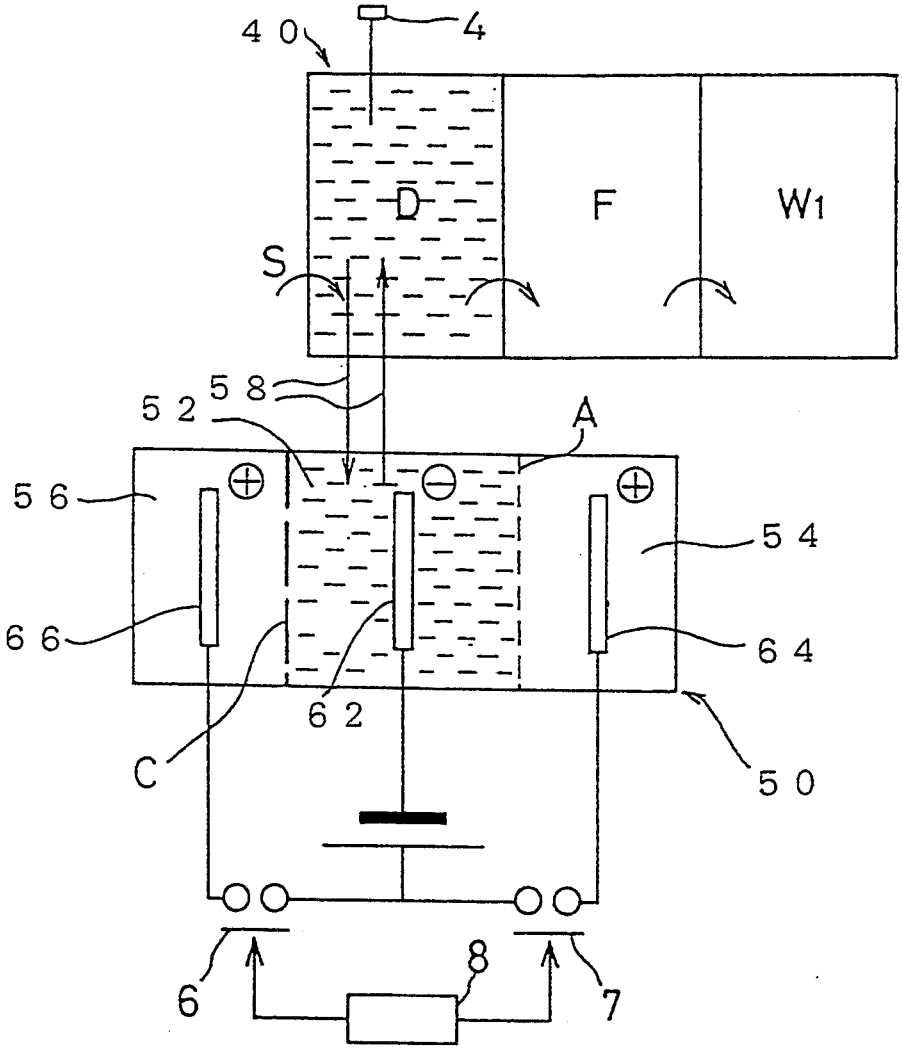
FIG. 4 is a schematic plan view of a photosensitive material processing apparatus according to a still further embodiment of the present invention.

FIG. 4 is a schematic plan view of a photosensitive material processing apparatus according to a still further embodiment of the present invention. The apparatus 40 includes a developing tank D, a fixing tank F, and a washing tank W1. Photosensitive material S is successively carried through these tanks. The respective tanks are replenished with the corresponding solutions in amounts corresponding to losses by evaporation. An electric conductive treatment tank 50 is in fluid communication with the developing tank D.

The treatment tank 50 is partitioned into three compartments 52, 54 and 56 by an anion exchange membrane A and a composite porous membrane C. A cathode 62 is disposed in the center compartment 52 for receiving the developer therein which is thus referred to as a cathode compartment. Anodes 64 and 66 are disposed in side compartments 54 and 56, respectively, for receiving an electrolyte solution which are thus referred to as anode compartments. The cathode compartment 52 is filled with the developer and the anode compartments 54 and 56 are filled with the electrolyte solution. A power supply is connected to the cathode 62 and anodes 64, 66 as shown in the figure and a controller 8 is combined via switches 6 and 7 with the power supply for providing electric conduction to the tank 50 in a controlled manner.

The cathode compartment 52 of the tank 50 receives the developer from the developing tank D through a circulation conduit 58. A command is given to the controller 8 to make either the switch 6 or 7. When the switch 6 is closed, electricity is conducted between the compartments 52 and 56 so that only regeneration of the developer is carried out. When the switch 7 is closed, electricity is conducted between the compartments 52 and 54 so that both regeneration of the developer and migration of bromide ions from the cathode compartment 52 to the anode compartment 54 (bromide ion removal) are carried out.

Where electric conduction is provided in accordance with the quantity of photosensitive material processed, the switch 7 is closed to provide electric conduction between the cathode 62 and the anode 64 via the anion exchange membrane A whereby the developing agent in oxidized state in the cathode compartment 52 is reduced to restore the processing capability and bromide ions migrate to the anode compartment 54 through the anion exchange membrane A só that the developer increases its activity. Where electric conduction is provided in accordance with the lapse of time during quiescent periods, the switch 6 is closed to provide electric conduction between the cathode 62 and the anode 66 via the composite porous membrane C whereby the developing agent in air oxidized state in the cathode compartment 52 is reduced to restore the processing capability. Since the composite porous membrane C which is selectively permeable does not allow passage of bromide ions, bromide ions which should serve as an anti-foggant are retained in the developer. If silver ions can be leached out of the developer in the cathode compartment 52 of the conductive treatment tank 50, electric conduction causes such silver ions to precipitate on the cathode 62.

In this way, electric conduction reduces the developing agent again to regenerate the developer. At the end of electric conduction, the developer in the cathode compartment 52 is fed back to the developing tank D through the circulation conduit 58.

Disposed in the developing tank D is a potentiometer 4 for measuring the potential of the developer. The electrical quantity to be conducted is controlled on the basis of this measurement.

It is possible to replace the composite porous membrane C by a cation exchange membrane. That is, where a cation exchange membrane is used in the arrangement of FIG. 4, there are achieved equivalent results to the composite porous membrane.

The quantity of photosensitive material processed is detected by measuring the feed of film or the number of processing cycles. The electrical quantity to be conducted to compensate for air oxidation is determined by previously measuring the quantities of oxidation occurring during the operating and non-operating times by means of the potentiometer and calculating an actual quantity of oxidation based on the data.

The feed of film is measured by detecting the number of revolutions of the film conveying roller in the film feed section and converting the detected number into a feed quantity.

More particularly, the electrical quantity for compensating for air oxidation is determined by previously carrying out an experiment to determine electrical quantities to be conducted to compensate for air oxidation taking place during predetermined operating and non-operating times, and the data are stored in a memory such as a look-up-table (LUT). On actual operation, actual operating and non-operating times are measured by means of a timer, an appropriate electrical quantity corresponding to the time measurements is read from the memory, and electricity is conducted on the basis of this value.

Alternatively, a similar experiment is carried out to determine the potentials of a developer corresponding to the operating and non-operating times and adequate electrical quantities necessary to gain such potential rises, and the data are stored in a memory. On actual operation, the potential of the developer is measured by the potentiometer, an appropriate electrical quantity corresponding to the potential measurement is read from the memory, and electricity is conducted on the basis of this value.

The silver halide photosensitive materials which can be processed in the practice of the invention include in terms of use, those for amateur, industrial, medical and scientific uses and in terms of processing system, those for black-and-white development, color development, conventional negative type processing, positive system based on photo reversal, positive system based on chemical reversal, positive system based on emulsion with a reversal mechanism, and positive system based on diffusion transfer. Included are a variety of black-and-white and color photosensitive materials, for example, black-and-white negative films, black-and-white papers, black-and-white reversal films, black-and-white reversal papers, black-and-white positive films, plate-making photographic photosensitive materials, radiographic photosensitive materials, microfilm photosensitive materials, color negative films, color reversal films, color papers, color positive films, and color reversal papers.

Various components of the photosensitive material are described below in detail.

The support may be any of transparent, opaque and semi-transparent supports while it is typically about 30 to 500 μm thick.

The emulsions may be based on various halides and various combinations thereof and includes one, two and three component systems, emulsions in which the distribution of halogen within grains is changed during grain formation, emulsions containing grains of laminar structure, emulsions containing grains having any core/shell ratio, emulsions of modified conversion, and junction type emulsions.

Included in the grains are hexagonal, octagonal and 14-sided structures and mixtures thereof, twins, plates, and spheres. Plates may have any aspect ratio while mixtures of various plates and mixtures of plates and other grains are also useful. Either a narrow or wide distribution of grain size is acceptable. For example, grain fractions of less than 0.1 μm, 0.1–0.4 μm, 0.4–1 μm, and more than 1 μm may be used alone or in combination.

The emulsion may contain a binder other than gelatin. Included are, for example, natural polymers, synthetic polymers and mixtures in which polymer fractions of various particle sizes are dispersed and mixed.

In these silver halide grains, any of sensitizing dyes, desensitizing dyes, stabilizers, chemical sensitizers, and physical sensitizers may be adsorbed or co-present during preparation. Further the emulsion mixture may contain various dyes, surfactants, hardeners, and oil. Directly in the emulsion or in oil, there may be contained anti-fading agents, anti-color-amalgamation agents, nucleating agents, matte agents, lubricants, mordants, color toning agents, co-developing agents, and developing agents.

Various metals may be added during grain formation or directly to the emulsion. Suitable metals include gold, platinum, rubidium, palladium, iron, cobalt, nickel, iridium, rhodium, and silver. They may be used in combination with various chelating agents.

In the case of color photosensitive materials, there may be further contained various couplers, for example, Y couplers of pivaloyl and benzoyl types, M couplers of pyrazolone and pyrazoloazole types, and C couplers of phenol and naphthol types. Also useful are functional couplers, for example, various DIR couplers, colored couplers, polymeric couplers and couplers having various coupling-off groups.

Photosensitive material layers can be formed by combining the above-mentioned emulsions with various additives and further with various couplers in the case of color photosensitive materials.

Even black-and-white photosensitive materials may include two or three layers by assigning a distinct function to each layer. Color photosensitive materials may be constituted from three or more layers which are sensitive to three colors or 4 or 5 separated light bands.

In a final form, the photosensitive material may contain in addition to the emulsion layers, a primer layer, intermediate layer, protective layer, peeling layer, separation layer, neutralizing layer, filter layer, evaporated layer, reflective layer, light-shielding layer and the like. Also useful are photosensitive materials having a back layer on the rear side of the support for curling prevention, antistatic, magnetic recording and other purposes.

As a whole, the photosensitive material may have an ISO value of 0.1 to 2,000 and a gradation of 0.1 to 10.

The processing agent which can be used herein may be any of premixed processing agents and processing agents of separate parts to be combined on use. The processing solutions include black-and-white and color developers, bleaching solutions, fixers, bleach-fixers, and stabilizers, while stop solutions, neutralizing solutions, hardening solutions, intensifiers, reducers, supersensitizing solutions, and toning solutions are also useful.

These processing solutions may contain various compounds in accordance with their purpose. For example, the developers may contain black-and-white developing agents, color developing agents, co-developing agents, antifoggants, surface development inhibitors, development accelerators, chelating agents, buffer agents, preservatives, anti-precipitating agents, anti-sludging agents, anti-tar agents and the like. In special cases, there may be added DIR releasing agents, dye developing agents, color precursor agents, desensitizers, anti-bronzing agents, in-developer-couplers, and competitive couplers.

Besides, alkaline and acidic agents for adjusting pH and various surfactants for changing surface tension may also be added. These additives may be added to solutions other than the developer. The solutions in final form may further contain a fluorescent brighteners, image stabilizers, water splashing agents, fungicides and bactericides. The order of processing steps of applying these processing agents to the photosensitive material may be a conventional one while the order may be tailored as the case may be.

Where the present invention is applied to developers, better results are obtained when black-and-white photosensitive material is combined with a black-and-white processing solution of a metal salt. The scheme is shown below.

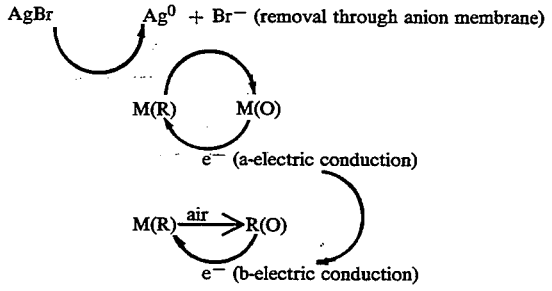

Note that a-conduction is electric conduction through an anion exchange membrane and that b-conduction is electric conduction through an only $OH^-$ permeable membrane.

Provided that air oxidation is neglected, when photosensitive material is developed, electric conduction (a-conduction) in a quantity equal to the development quantity will completely regenerate the developing agent while removing $Br^-$ so that the resultant waste liquid is substantially zero which is favorable from an environmental aspect.

Where air oxidation takes place, additional electric conduction (b-conduction) will accomplish substantial elimination of waste liquid.

Similar electric conduction can compensate for a loss by air oxidation of a conventional hydroquinone type developer. The hydroquinone participated in development can also be partially regenerated by effecting electric conduction before a sulfite is added thereto, resulting in a substantially decreased amount of waste liquid.

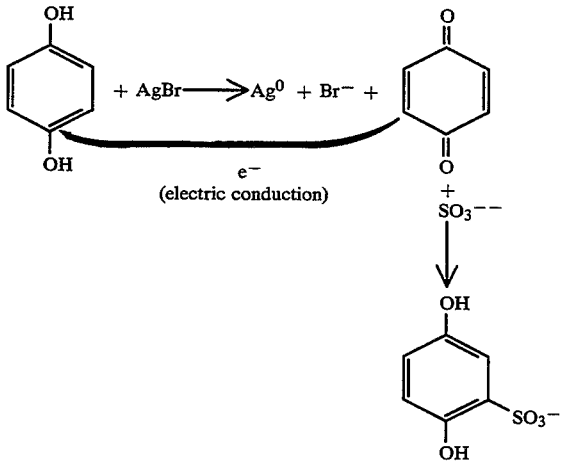

However, little of the above-mentioned advantage is obtained in the case of color developer because more than 90% of the developer participated in development is consumed for color development.

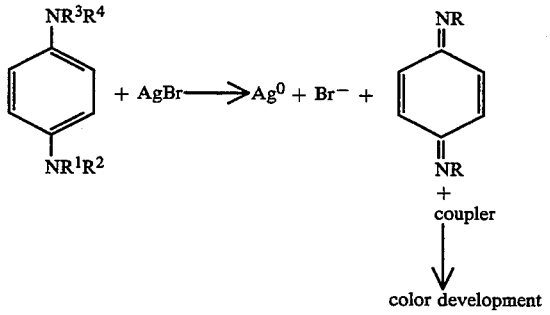

Even so, oxides resulting from air oxidation, if any, can be regenerated by b-conduction. This can decrease the amount of waste liquid. Since $Br^-$ is also removed, replenishment for the purpose of maintaining the $Br^-$ value can be decreased, resulting in a decreased amount of waste liquid.

The present invention is essentially distinguished over JP-A 209471/1991, 273237/1991, 250449/1992, and 125407/1992 in that b-conduction can dispense with wasteful replenishment and hence decrease the amount of waste liquid. This b-conduction allows for 100% regeneration in the case of an inorganic metal type developer, for which the invention is worthwhile.

Included in the processing solution are inorganic and organic developers. The inorganic developer contains a developing agent in the form of a metal compound capable of reversible oxidation and reduction. The metal of the metal compound is a transition metal which can have a plurality of different oxidation states such as Ti, V, Cr and Fe. It is then theoretically believed that when used as the developing agent, a metal compound in a lower oxidation state than the maximum oxidation state may be used for utilizing its reducing force. Such a lower oxidation state is generally $Ti^{3+}$ for titanium, $V^{2+}$ for vanadium, $Cr^{2+}$ for chromium, and $Fe^{2+}$ for iron, with $Ti^{3+}$ and $Fe^{2+}$ being preferred.

The metal compounds may be complexes as well as conventional salts. Exemplary salts are halides such as chlorides, bromides, and iodides, and oxalates, sulfates, acetates and citrates. More specifically, there may be used $TiCl_3$, $TiBr_3$, $TiI_3$, $FeCl_2$, $FeBr_2$, $VCl_2$, $V(SO_4)$, $Fe(COO)_2$, $FeSO_4$, $Fe(CH_3COO)_2$, and iron (II) citrate. The complexes have center metals such as $Ti^{3+}$ and $Fe^{2+}$, with the ligands being preferably multidentate ligands. Exemplary ligands include aminopolycarboxylic acids and salts thereof such as ethylenediaminetetraacetic acid (EDTA) and diethylenetriaminepentaacetic acid (DTPA), aminopolyphosphoric acids and salts thereof such as ethylenediamine-N,N,N',N'-tetramethylene phosphoric acid and 1,3-diaminopropanol-N,N,N',N'-tetramethylene phosphoric acid, carboxylic acids and salts thereof such as nitrilotriacetic acid, oxalic acid, and citric acid, and phosphoric acid and salts thereof such as nitrilo-N,N,N-trimethylene phosphoric acid and propylamino-N,N-dimethylene phosphoric acid. Preferred among these are complexes having EDTA and DTPA ligands. It is also possible to form such complexes in the developer by adding metal salts and ligand compounds thereto. This procedure is also preferred in the practice of the invention. For the detail of these metal compounds, reference is made to JP-B 41899/1979 and the literature cited therein. It is understood that metal compounds in higher oxidation state, if they are stable, may be used whereupon they are reduced by electric conduction into a state capable of providing development. Often the metal compound is contained in the developer in a concentration of 1 to 100 g/l, preferably 5 to 60 g/l.

In the developer there may be contained various additives such as pH buffer agents and anti-foggants. For such additives, reference is made to JP-B 41899/1979. The developer is used at pH 0.5 to 14, preferably pH 5 to 8.

Another processing solution used herein is a black-and-white developer containing an organic developing agent. This developing agent is primarily comprised of hydroquinones such as hydroquinone, while combinations of hydroquinones with 1-phenyl-3-pyrazolidones or combinations of hydroquinones with p-aminophenols are preferred for improved performance. The hydroquinone developing agents are generally used in amounts of 0.01 to 1.5 mol/l, preferably 0.05 to 1.2 mol/l. In addition, the p-aminophenol or 3-pyrazolidone developing agents are generally used in amounts of 0.0005 to 0.2 mol/l, preferably 0.001 to 0.1 mol/l.

Used in the black-and-white developer are preservatives in the form of sulfites such as sodium sulfite, potassium sulfite, lithium sulfite, ammonium sulfite, sodium bisulfite, and potassium metabisulfite. The sulfites are generally used in amounts of at least 0.2 mol/l, preferably at least 0.4 mol/l, with the upper limit being preferably 2.5 mol/l.

Such a black-and-white developer is preferably at pH 8.5 to 13, more preferably pH 9 to 12.

A sill further processing solution is a color developer for use in the development of color photosensitive material. It is preferably an alkaline aqueous solution containing an aromatic primary amine color developing agent as an active ingredient. Useful color developing agents used herein include aminophenol compounds and p-phenylenediamine compounds. The p-phenylenediamine compounds are preferred and typical examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and salts thereof with sulfuric acid, hydrochloric acid and p-toluenesulfonic acid. These compounds may be used in admixture of two or more if desired.

Generally, the color developer contains pH buffer agents such as alkali metal carbonates, borates and phosphates and development retarders or anti-foggants such as bromide salts, iodide salts, benzimidazoles, benzothiazoles and mercapto compounds. If desired, there may be contained various preservatives such as hydroxylamine, diethylhydroxylamine, sulfites, hydrazines, phenylsemicarbazides, triethanolamine, catecholsulfonic acids, and triethylenediamine(1,4-diazabicyclo[2,2,2]octanes); organic solvents such as ethylene glycol and diethylene glycol; development promoters such as benzyl alcohol, polyethylene glycol, quaternary ammonium salts, and amines; dye-forming couplers; competitive couplers; chemical fogging agents such as sodium boron hydride; auxiliary developing agents such as 1-phenyl-3-pyrazolidone; thickeners; and various chelates as typified by aminopolycarboxylic acids, aminopolyphosphonic acids, alkylphosphonic acids, phosphonocarboxylic acids, for example, ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylene phosphonic acid, ethylenediamine-N,N,N',N'-tetramethylene phosphonic acid, ethylenediamine-di(o-hydroxyphenylacetic acid) and salts thereof.

The color developer is at pH 9 to 12.

Also included in the processing solution is a fixer for use in fixation of black-and-white photosensitive material after its development. The fixer is an aqueous solution containing a fixing agent at pH 3.8 or higher, preferably pH 4.2 to 7.0.

The fixing agent includes sodium thiosulfate and ammonium thiosulfate, with the ammonium thiosulfate being preferred for fixing rate. The amount of the fixing agent used is preferably about 0.1 to 3 mol/l although it generally varies over a wide range.

In the fixer, there may be contained water-soluble aluminum salts serving as hardeners, for example, aluminum chloride, aluminum sulfate and potassium alum. Also there may be contained tartaric acid, citric acid, gluconic acid and derivatives thereof alone or in admixture of two or more, preferably in an amount of at least 0.005 mol per liter of the fixer, especially 0.01 to 0.03 mol/l.

The processing solution having a fixing ability for use in the processing of color photosensitive material is a fixer or blix solution. In the fixer or blix solution, thiosulfates are used as fixing agents, with ammonium thiosulfate salt being especially preferred. They are added in amounts of 0.1 to 5.0 mol/l, preferably 0.5 to 2.0 mol/l. Preservatives used herein are generally sulfites while ascorbic acid, carbonyl bisulfite adducts and carbonyl compounds may also be added. If desired, there are added buffer agents, fluorescent brighteners, chelating agents and antifungal agents.

In the blix solution, iron complexes are contained as bleaching agents, with aminopolycarboxylic acid iron complexes being especially preferred. They are added in amounts of 0.01 to 1.0 mol/l, preferably 0.05 to 0.50 mol/l. Additionally, a variety of compounds may be used as bleach promoters. Exemplary bleach promoters are compounds having a mercapto or disulfide group as described in U.S. Pat. No. 3,893,858, German Patent No. 12 90 812, JP-A 95630/1978, and Research Disclosure No. 17129 (July 1978), thiazoline derivatives as described in JP-A 140129/1975, thiourea derivatives as described in U.S. Pat. No. 3,706,561, iodides as described in JP-A 16235/1983, polyethylene oxides as described in German Patent No. 27 48 430, and polyamine compounds as described in JP-B 8836/1970.

Both the fixer and the blix solution are used at pH 4.0 to 7.0.

For the processing of black-and-white and color photosensitive materials, any of other various processing solutions may be used. For the detail of processing of black-and-white photosensitive materials, reference is made to JP-A 93737/1989, 250947/1989, 103035/1990, 103037/1990, 71260/1990, 267559/1986, and 46652/1991. For the detail of processing of color photosensitive materials, reference is made to JP-A 70857/1988, 190889/1989, 198754/1989, and 106050/1989. For the detail of black-and-white and color photosensitive materials, reference is made to JP-A 259359/1989 and other patents mentioned above.

For the photosensitive materials and processing solutions which can be used herein, reference may be made to JP-A 33845/1991, pages 13–26 and 9–13, respectively.

The processor to which the present invention is effectively applicable is any of many types of processors described in Phot. Sci. Eng., 5, 48–54 (1961), inter alia, drum processors, roller processors, motion picture film processors, leader belt type processors, roller conveyor type processors, processors with a reduced opening, slit type processors with a reduced opening and a reduced tank solution volume, closed type processors with an extremely reduced opening, and processors having multi-compartment processing tanks. For more detail, the drum processors are described in Photographic Industry, December 1974, page 45, the roller processors are described in Photographic Industry, February 1975, page 71, the motion picture film processors are described in Photographic Industry, April 1975, page 40, the leader belt type processors are described in Photographic Industry, May 1975, page 36, the roller conveyor type processors are described in Photographic Industry, June 1975, page 41.

One of the aspects which were not considered in prior art processors relates to an opening (K) which is an interfacial area (S) between solution and air divided by a solution volume (V), that is, $K=S/V$. In this respect, reference is made to JP-A 57835/1978, 153645/1986, 250648/1986, 92954/1987, 273534/1987, 182651/1988, 182652/1988, 182653/1988, 82033/1989, 166040/1989, 266541/1989, 266542/1989, 302252/1989, 310351/1989, 310352/1989, 319038/1989, and 319040/1989 and Japanese U.M. Application Kokai No. 178830/1988.

Processors having a reduced solution volume (V) have a relatively increased solution replacement rate and for a low utilization of process, those having a reduced opening (K) and a reduced tank solution volume (V) are preferred. In this respect, reference is made to JP-A 77851/1986, 131138/1988, 148944/1988, 148945/1988, 216050/1988, 235940/1988, 44938/1989, 26855/1989, 114847/1989, 129253/1989, 140148/1989, 154155/1989, 163743/1989, and 166040/1989.

Also useful are the closed type processors disclosed in JP-A 84642/1990, 69744/1990, 68548/1990 and 33850/1991.

Exemplary considerations regarding the interactions between processor parts and solutions include an aspect of rust as part applicability, an aspect of leaching of photographically deleterious components, and an aspect of physically deteriorating processor parts. These aspects are discussed in JP-A 186342/1990 and 186344/1990. Another new version of processor includes multi-compartment processing tanks as disclosed in JP-A 267648/1989, 67554/1990, 125255/1990, 130548/1990, 186340/1990, 205846/1990, 205847/1990, 230145/1990, 240651/1990, 242249/1990, 267549/1990, 269335/1990, 280149/1990, and 310557/1990.

Among these, the processing systems to which the present invention is applicable with more advantages include processors having a belt conveyor mechanism, processors having pairs of conveyor rollers, slit type processors, closed type processors, and processors having multi-compartment processing tanks. In some cases, it is effective to use channel transfer type processors as disclosed in U.S. Pat. No. 2,186,927, JP-A 159645/1981, and Japanese U.M. Application Kokai Nos. 167933/1977, 40245/1978, 59829/1978, 138641/1980, and 28839/1983.

EXAMPLES

Examples of the present invention are given below by way of illustration and not by way of limitation.

Example 1

First preparation of photosensitive material is described.

Preparation of Emulsion

| | |
|---|---|
| Part I | |
| Water | 1.0 l |
| Gelatin | 20 g |
| Sodium chloride | 20 g |
| 1,3-dimethylimidazolizine-2-thion | 20 mg |
| Sodium benzenethiosulfonate | 6 mg |
| Part II | |
| Water | 400 ml |
| Silver nitrate | 100 g |
| Part III | |
| Water | 400 ml |
| Sodium chloride | 30.5 g |
| Potassium bromide | 14.0 g |
| Potassium hexachloroiridate (III) (0.001% aqueous solution) | 15 ml |
| Ammonium hexabromorhodate (III) (0.001% aqueous solution) | 1.5 ml |
| Part IV | |
| Water | 400 ml |
| Silver nitrate | 100 g |
| Part V | |
| Water | 400 ml |
| Sodium chloride | 30.5 g |
| Potassium bromide | 14.0 g |
| $K_4Fe(CN)_6$ | 400 mg |

With stirring, Parts II and III were simultaneously added to Part I at 38° C. and pH 4.5 over 10 minutes, forming grains of 0.16 μm. To this solution, Parts IV and V were added over 10 minutes. Finally 0.15 g of potassium iodide was added to complete grain formation. Thereafter the emulsion was conventionally washed with water by a flocculation method, and 30 g of gelatin was then added thereto. The emulsion was equally divided into two portions and adjusted to pH 5.5 and pAg 7.5. After adding 3.7 mg of sodium thiosulfate and 6.2 mg of chloroauric acid to one portion, the emulsion was chemically sensitized for optimum sensitivity at 65° C. (The other portion was later used in Example 7.)

Preparation of Coated Sample

The emulsion was ortho-sensitized by adding $5\times10^{-4}$ mol/mol of silver of an ortho-sensitizing dye (VII-1) shown below. To the emulsion there were added 2.5 g/mol of silver of hydroquinone and 50 mg/mol of silver of 1-phenyl-5-mercaptotetrazole as reducing sensitizers, 25% by weight of polyethylacrylate latex plasticizer based on the weight of the gelatin binder, and 2-bis(vinylsulfonylacetamide)ethane as a hardener. The emulsion was coated onto a polyester support to give coverages: 3.0 g/m$^2$ of Ag and 1.0 g/m$^2$ of gelatin. On this emulsion coating, a protective layer was simultaneously coated.

At the same time as the emulsion coating, a non-sensitive upper layer was coated from a composition which contained polymethylmethacrylate (mean particle size 3.4 μm) as a matte agent in an amount to give a coverage of 0.10 g/m$^2$, gelatin in an amount to give a coverage of 1.0 g/m$^2$, sodium p-dodecylbenzenesulfonate as a coating aid, and a fluorinated surfactant of the structural formula (VII-2) shown below.

(VII-1)

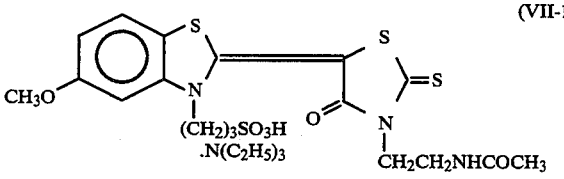

(VII-2)

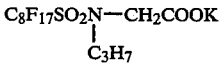

The support used herein had a back layer and a back protective layer of the following compositions.

| Back protective layer | |
|---|---|
| Gelatin | 2.0 g/m$^2$ |
| Sodium dodecylbenzenesulfonate | 80 mg/m$^2$ |
| Dye (VII-3) | 70 mg/m$^2$ |
| Dye (VII-4) | 70 mg/m$^2$ |
| Dye (VII-5) | 90 mg/m$^2$ |
| 1,3-divinylsulfonyl-2-propanol | 60 mg/m$^2$ |

(VII-3)

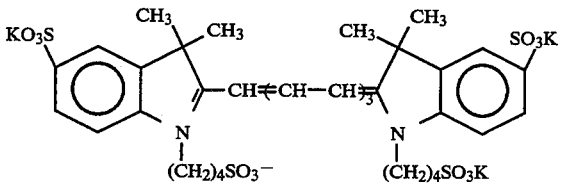

(VII-4)

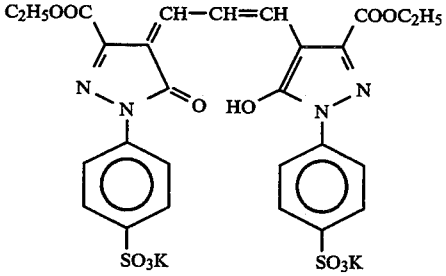

-continued (VII-5)

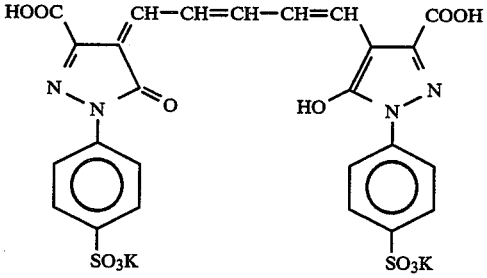

| Back layer | |
|---|---|
| Gelatin | 0.5 g/m$^2$ |
| polymethylmethacrylate (particle size 4.7 μm) | 30 mg/m$^2$ |
| Sodium dodecylbenzenesulfonate | 20 mg/m$^2$ |
| fluorinated surfactant (VII-2) | 2 mg/m$^2$ |
| Silicone oil | 100 mg/m$^2$ |

Processing

The thus prepared photosensitive material was processed according to the following procedure using an automatic processor FG360F manufactured by Fuji Photo-Film Co., Ltd.

| Step | Time | Temp. | Replenishment* | Tank volume |
|---|---|---|---|---|
| develop | 16 sec. | 38° C. | 250 ml/m$^2$ | 6.5 l |
| fix | 20 sec. | 38° C. | 670 ml/m$^2$ | 6 l |
| wash | 20 sec. | 38° C. | 6 l/m$^2$ | 6 l |
| dry | 20 sec. | 56° C. | — | — |

*Replenishment unit: ml/m$^2$ is milliliter per square meter of photosensitive material The developer used herein was LD-835 containing an organic developing agent and a sulfite preservative (commercially available from Fuji Photo-Film Co., Ltd.). The fixer was LF-308 containing a thiosulfate fixing agent (commercially available from Fuji Photo-Film Co., Ltd.). Wash water is city water.

In accordance with the above procedure, the processor was run three rounds (developing tank) a day. This is designated Procedure 1A.

In Procedure 1A, after the three-round running operation, the developer was allowed to stand for a week whereupon photosensitive material was developed therewith to find the occurrence of silver stains. Silver stains extinguished after 3 or more quarter-size sheets of photosensitive material were passed through the developing tank, but there still remained a likelihood of development fog.

Procedure 1A was repeated except that the developing tank of the processor was changed as follows. This is designated Procedure 1B. The developing tank was partitioned solely by the anion exchange membrane A1 as in FIG. 1, with the anode 22 immersed in the electrolyte solution E1 and the cathode 21 immersed in the developer (that is, the arrangement of FIG. 1 minus diaphragm M1 and anode 24).

The cathode was a sheet of molybdenum-containing stainless steel corresponding to SUS316 (NTK316 manufactured by Nippon Metal Industry K.K., size 30 cm×30 cm, gage 2 mm). The anode was a carbon sheet (Kure-Sheet manufactured by Kureha Chemical Industry K.K., size 30 cm×30 cm, gage 3.2 mm). The anion exchange membrane was Neosepta AM-3 (manufactured by Tokuyama Soda K.K., size 30 cm×30 cm). The electrolyte solution was a 3% $Na_2CO_3$ aqueous solution. Electricity was conducted between the anode and cathode by applying a voltage of 2.8 V to provide a current flow of 1.5 A (current density 0.17 A/dm$^2$). The running conditions included one day of 3-round running operation and a next day of quiescence, with this cycle being repeated. Electricity was conducted for 10 seconds at intervals of 1 hour.

In this Procedure 1B, no silver stains occurred, but development fog occurred because the $Br^-$ concentration in the developer was substantially lowered.

Procedure 1A was repeated except that the developing tank of the processor was changed exactly as in FIG. 1. This is designated Procedure 1C. The only $H^+$and/or $OH^-$ permeable diaphragm was PEC-1000 (manufactured by Toray K.K., size 30 cm ×30 cm). Electricity was conducted for 5 seconds across combination Ia and for 5 seconds across combination Ib at intervals of 1 hour.

In this Procedure 1C, no silver stains occurred and no development fog occurred because the $Br^-$ concentration in the developer was maintained optimum.

Actually, the $Br^-$ concentration in the developer was measured. The fresh developer had a $Br^-$ concentration of 3 g/l calculated as KBr. The developer after running operation according to Procedure 1B had a $Br^-$ concentration of 2.6 g/l calculated as KBr. The developer after running operation according to Procedure 1C had a $Br^-$ concentration of 3.2 g/l calculated as KBr.

Procedure 1C was repeated except that the only $H^+$ and/or $OH^-$ permeable diaphragm was replaced by a cation exchange membrane (Neosepta CMX, manufactured by Tokuyama Soda K.K., size 30 cm×30 cm). The results were equivalent to those of Procedure 1C.

It is to be noted that silver stain was evaluated by visual observation and development fog was evaluated in terms of a visually observed density.

Example 2

Procedure 1B of Example 1 was repeated except that the developer was replaced by the following composition (I) or (II).

| Formulation | (I) | (II) |
|---|---|---|
| (common to both tank solution and replenisher) | | |
| Water | 600 ml | 600 ml |
| Chelest ® PA (free acid of DTPA) | 78.6 g | — |
| Kirest P (DTPA-5Na, liquid) | — | 197 g |
| $NH_4OH$ (25%) | 150 ml | — |
| NaOH | — | 32 g |
| Citric acid | 38.4 g | 38.4 g |
| KBr | 2.0 g | 2.0 g |
| Titanium trichloride solution (Wako Junyaku K.K., catalog No. 204-01665, 1st grade reagent) | 150 ml | 150 ml |
| pH | 6.0 | 6.0 |

When composition (I) was used, the photosensitive material feed speed of the processor was slowed down to give a development time of 18 seconds, a fixing time of 22.5 seconds, a washing time of 22.5 seconds, and a drying time of 22.5 seconds. The amount of developer replenished was 50 ml/m$^2$ of photosensitive material. This is designated Procedure 2B(I).

In Procedure 2B(I), electricity was conducted for 15 minutes per square meter of photosensitive material being processed and for 20 seconds at intervals of 3 hours during quiescent periods.

When composition (II) was used, the photosensitive material feed speed of the processor was further slowed down to give a development time of 30 seconds, a fixing time of 37.5 seconds, a washing time of 37.5 seconds, and a drying time of 37.5 seconds. This is designated Procedure 2B(II). Electric conduction was the same as in Procedure 2B(I).

Twenty quarter-size (10×12 inches) sheets of photosensitive material were processed on a running basis according to each of Procedures 2B(I) and 2B(II). The last sheets were examined for photographic performance to find development fog.

Each of Procedures 2B(I) and 2B(II) was carried out in accordance with Procedure 1C of Example 1 using the developing tank of FIG. 1. Electric conduction was for 15 minutes per square meter of photosensitive material being processed across combination Ia and 5 seconds across combination Ib at intervals of 3 hours during quiescent periods, the remaining conditions being the same as above. These are designated Procedures 2C(I) and 2C(II) corresponding to Procedures 2B(I) and 2B(II), respectively.

Twenty quarter-size sheets of photosensitive material were processed on a running basis according to each of Procedures 2C(I) and 2C(II). The last sheets were examined for photographic performance to find no problem.

No silver stains occurred with the developers of these formulations because of the absence of a sulfite preservative.

Actually, the developers (I) and (II) were measured for $Br^-$ concentration after Procedures 2B(I), 2B(II), 2C(I) and 2C(II) on a running basis. In Procedures 2B(I) and 2B(II), the developers had a $Br^-$ concentration of 1.3 g/l calculated as KBr. In Procedure 2C(I) and 2C(II), the developers had a $Br^-$ concentration of 1.9 g/l calculated as KBr. These data indicate that development fog occurred in Procedures 2B(I) and 2B(II) because the $Br^-$ concentration became too low with an accompanying pH rise. Some white precipitates formed in Procedure 2B(I). No development fog occurred in Procedures 2C(I) and 2C(II) because the $Br^-$ concentration was maintained optimum with little pH rise.

Procedures 2C(I) and 2C(II) were repeated except that the only $H^+$ and/or $OH^-$ permeable diaphragm was replaced by a cation exchange membrane (Neosepta CMX, manufactured by Tokuyama Soda K.K., size 30 cm×30 cm). The results were equivalent to those of Procedures 2C(I) and 2C(II).

It is to be noted that development fog was evaluated in terms of a visually observed density.

Example 3

Procedure 1A of Example 1 was repeated except that unexposed photosensitive material was processed 10 rounds (fixing tank) on a running basis while reducing the amount of the fixer replenished to ⅓, that is, 223 ml/m$^2$. This is designated Procedure 3A. Desilvering was deficient in Procedure 3A.

Procedure 3A was repeated except that a fixing tank of the same arrangement as the developing tank of Procedure 1B of Example 1 was used. Electric conduction was 30 minutes per square meter of photosensitive material being processed. This is designated Procedure 3B. Desilvering was satisfactory in Procedure 3B at the replenishment rate of 223 ml/m$^2$, but deficient at a reduced replenishment rate of 70 ml/m$^2$.

Procedure 3A was repeated except that the fixing tank arrangement was changed as shown in FIG. 2. This is designated Procedure 3C. The cation exchange membrane used was Neosepta CMX (manufactured by Tokuyama Soda K.K., size 30 cm×30 cm). Electric conduction was 25 minutes across combination IIb and 5 minutes across combination IIa per square meter of photosensitive material being processed. Desilvering was satisfactory in Procedure 3C even at a reduced fixer replenishment rate of 50 ml/m$^2$. This is probably because inhibition against fixation by entrainment of $K^+$ from developer LD-835 was restrained.

Actually, the fixer was analyzed for composition after running operation according to Procedure 3B (replenishment 70 ml) and Procedure 3C. The fresh fixer has an Ag concentration of 0 g/l, a $Br^-$ concentration of 0 g/l and a $K^+$ concentration of 0 g/l. The fixer after running operation according to Procedure 3B has an Ag concentration of 0.47 g/l, a $Br^-$ concentration of 0.2 g/l and a $K^+$ concentration of 79 g/l. The fixer after running operation according to Procedure 3C has an Ag concentration of 0.45 g/l, a $Br^-$ concentration of 0.3 g/l and a $K^+$ concentration of 0.3 g/l.

It is to be noted that desilvering was evaluated deficient when the residual silver amount was above 5 μg/cm$^2$ as measured by fluorescent X-ray analysis.

Example 4

The photosensitive material (color negative film) of Example 1 in JP-A 273237/1991 was processed according to the procedure described therein on a running basis over 10 months at a rate of 100 rolls of 135 size per day. The developing tank corresponded to the arrangement of Procedure 1B of Example 1 of the present disclosure. Electricity was conducted by applying a voltage of 1.2 V to provide a current flow of 1.35 A (current density 0.45 A/dm$^2$). This is designated Procedure 4B.

After the 10-month running operation according to Procedure 4B, the anion exchange membrane had to be replaced by a new one because it was seriously deteriorated.

Procedure 4B was repeated except that the developing tank was changed to the tank shown in FIG. 3. This is designated Procedure 4C. The cation exchange membrane used was Neosepta CMX (manufactured by Tokuyama Soda K.K.).

After the 10-month running operation according to Procedure 4C, the anion exchange membrane had experienced no deterioration. The use of the cation exchange membrane was effective for prolonging the life of the anion exchange membrane.

Example 5

Sample No. 201 (color negative film) of Example 2 in JP-A 259359/1989 was exposed and then processed according to the procedure described therein 5 rounds in the color developing tank using an automatic processor FNCP-600II (manufactured by Fuji Photo-Film Co., Ltd.). A portion (1 liter) was taken out of the overflow of the color developer and 4 g/l of KBr was added thereto. The color developer used herein had the composition shown in Table 1.

TABLE 1

| Color developer | Tank (g) | Replenisher (g) |
|---|---|---|
| Diethylenetriaminepentaacetic acid | 1.0 | 1.1 |
| 1-hydroxyethylidene-1,1-diphosphonic acid | 3.0 | 3.2 |
| Sodium sulfite | 4.0 | 4.9 |
| Potassium carbonate | 30.0 | 30.0 |
| Potassium bromide | 1.4 | — |
| Potassium iodide | 1.5 mg | — |
| Hydroxylamine hydrogensulfate | 2.4 | 3.6 |
| 4-(N-ethyl-N-β-hydroxyethylamino)-2-methylaniline hydrogensulfate | 4.5 | 7.2 |
| Water totaling to | 1.0 l | 1.0 l |
| pH | 10.05 | 10.10 |

The overflow was channeled to a processing tank of the same arrangement as the developing tank used in Procedure 1B of Example 1 except for volume where electric conduction was carried out. The electrolyte solution was an aqueous solution of 3% $Na_2CO_3$ (adjusted to pH 10.0). The anode and cathode used were the same as in Example 1 except that their effective surface area (size) was 19 cm×15 cm. The anion exchange membrane used was Neosepta AM-3 (manufactured by Tokuyama Soda K.K., size 30 cm×30 cm). Electricity was conducted for 2 hours by applying a voltage of 3.0 V to provide a current flow of 1.14 A (current density 0.4 A/dm$^2$). This is designated Procedure 5B.

Procedure 5B was repeated except that the processing tank was changed to the tank shown in FIG. 3. This is designated Procedure 5C. The cation exchange membrane used was Neosepta CMX (manufactured by Tokuyama Soda K.K., size 19 cm×15 cm).

The overflow solution as such and the overflow solutions after electric conduction according to Procedures 5B and 5C were analyzed for composition. The results are shown in Table 2.

TABLE 2

| Overflow | Initial | Procedure 5B | Procedure 5C |
|---|---|---|---|
| Hydroxylamine hydrogensulfate (g/l) | 2.02 | 0.16 | 1.88 |
| Sodium sulfite (g/l) | 3.62 | 3.76 | 3.70 |
| 4-(N-ethyl-N-β-hydroxyethylamino)-2-methylaniline hydrogensulfate (g/l) | 4.44 | 4.49 | 4.49 |
| Potassium bromide (g/l) | 5.13 | 0.22 | 0.23 |
| pH | 10.00 | 12.05 | 10.22 |
| Specific gravity | 1.053 | 1.051 | 1.047 |

Table 2 shows that the hydroxylamine hydrogensulfate decomposed in Procedure 5B, but not in Procedure 5C. This indicates that for the color developer containing a hydroxylamine hydrogensulfate preservative, the electric conduction system according to Procedure 5C is advantageous. If hydroxylamine hydrogensulfate decomposes, ammonia could generate in the solution which would cause fog.

A pH rise due to electric conduction was observed in Procedure 5B, but not in Procedure 5C. Procedure 5B eliminates a need for adding alkali to the replenisher, but leaves a likelihood of fog due to the pH rise with a conventional replenisher formulation. Procedure 5C which does not entail a pH rise allows a conventional replenisher formulation to maintain optimum pH. Stated inversely, Procedure 5B allows an alkali agent to be decreased from the replenisher, but Procedure 5C does not.

Example 6

Procedure 5C in Example 5 is designated Procedure 6C wherein the processing tank was of FIG. 3.

Procedure 6C was repeated except that the processing tank was replaced by the tank of FIG. 2 and the fixing compartment was filled with a developer. This electric conduction treatment is designated Procedure 6D.

More specifically, in Procedure 6D, electric conduction was performed across combination IIb in FIG. 2 during processing of photosensitive material for removing halogen and regenerating part of the developing agent (as in Procedure 1B of Example 1). During quiescent periods, electric conduction was performed across combination IIa in FIG. 2. The anion exchange membrane A1 used was Neosepta AM-3 (manufactured by Tokuyama Soda K.K.). For electric conduction across IIb, a current flow of 1 A (0.3 A/dm$^2$) was conducted for 30 seconds per color negative film. For electric conduction across IIa during quiescent periods, a current flow of 1 A (0.3 A/dm$^2$) was conducted for 10 seconds at intervals of 3 hours.

Running operation was continued for one month in accordance with Procedures 6C and 6D under conditions including a processing rate of two color negative films/day and a temperature control time of 10 hours/day. After one month, the developer components in the tank solution were analyzed with the results shown in Table 3.

TABLE 3

| | Sodium sulfite | Hydroxylamine | Color developing agent |
|---|---|---|---|
| Procedure 6C | 1.73 g/l | 1.39 g/l | 3.96 g/l |
| Procedure 6D | 3.78 g/l | 2.33 g/l | 4.43 g/l |

It is evident that addition of conductive treatment across IIa to conductive treatment across IIb improves the long-term solution stability.

It was found that the solution can be maintained stable over a long term by providing an additional controlled electric conduction system as compared with JP-A 209471/1991, 273237/1991, 125407/1992, and 250449/1992 which are assigned to the same assignee as the present invention.

Example 7

Photosensitive Material

The preparation of photosensitive material in Example 1 was repeated except for the following change. The emulsion formed from Parts I to V was divided into two portions, one of which was used in Example 1. The other portion of the emulsion was adjusted to pH 5.3 and pAg 7.5 and combined with 1.0 mg of sodium thiosulfate and 2.6 mg of N,N-dimethylselenium urea, and 4 mg of sodium benzenethiosulfonate. After 6.2 mg of chloroauric acid was added, the emulsion was chemically sensitized for optimum sensitivity at 55° C.

Processing Solutions

| | |
|---|---|
| Water | 800 ml |
| Aqueous ammonia (28%) | 100 ml |
| EDTA | 60 g |
| Citric acid (anhydrous) | 38.4 g |
| KBr | 1 g |
| Ferrous sulfate ($FeSO_4.7H_2O$) | 55.6 g |

-continued

| | |
|---|---|
| pH | 6.5 to 7.0 |
| Water totaling to | 1 liter |

The fixer was printing plate making fixer GR-F1 commercially available from Fuji Photo-Film Co., Ltd.

Processing steps

| Step | Time | Temperature | Replenishment* |
|---|---|---|---|
| Development | 30 sec. | 38° C. | 5 ml/half-size |
| Fixation | 20 sec. | 38° C. | 5 ml/half-size |
| Washing | 20 sec. | 38° C. | 1 l/min. |

*The replenishment amounts of developer and fixer are expressed in milliliter per sheet of half-size (20 × 12 inches).

Apparatus as shown in FIG. 4

Electric Conduction

Cathode 62: stainless steel SUS316, 20 cm×13 cm×2 mm thick

Anode 64: Kureka sheet (commercially available from Kureha Chemical K.K.), 20 cm×13 cm×3 mm thick Anode 66: the same as above Anion exchange membrane A: AM-3 (commercially available from Tokuyama Soda K.K.), 20 cm×13 cm Composite porous membrane C: PEC-1000 (commercially available from Toray K.K.), 20 cm×13 cm Electrolyte solution: 0.3% $Na_2CO_3$ solution Power supply: GP060-20 DC power supply Electric conduction was performed using a constant current apparatus (manufactured by Takasago Ltd.) under conditions: 2 volts and 1 amperes (current density 0.4 A/dm$^2$) for both the combinations of cathode 62-anode 64 and cathode 62-anode 66.

Procedure 7A (Comparison)

Only electric conduction across cathode 62-anode 64 was employed.

While conducting electricity at 2 volts and 1 amperes (current density 0.4 A/dm$^2$) for 60 seconds per half-size sheet, running operation was carried out under the schedule of 1000 sheets on the first day, 0 sheet on the second day, 10 sheets on the third day, 0 sheet on the fourth day, and 10 sheets on the fifth day.

Additionally, photosensitive material was processed every day with the processing solutions at the end of running operation for determining a change of the maximum density (Dmax) of an image.

Procedure 7B (Invention)

In addition to electric conduction across cathode 62-anode in the same manner as Procedure 7A, electricity was conducted across cathode 62-anode 66 at 2 volts and 1 amperes (current density 0.4 A/dm$^2$) for 20 seconds at intervals of 6 hours. Running operation was carried out as in Procedure 7A. A change of the maximum density (Dmax) was also determined as in Procedure 7A.

The results are shown in Table 4.

TABLE 4

| | | Procedure | |
|---|---|---|---|
| | | 7A | 7B |
| Fresh* | AM | 4.92 | 4.92 |
| | PM | 4.93 | 4.94 |
| 1st day | AM | 4.77 | 4.92 |
| | PM | 4.53 | 4.91 |
| 2nd day | AM | 4.23 | 4.92 |
| | PM | 4.01 | 4.90 |
| 3rd day | AM | 3.78 | 4.92 |
| | PM | 3.57 | 4.92 |
| 4th day | AM | 3.32 | 4.89 |
| | PM | 3.22 | 4.91 |
| 5th day | AM | 3.01 | 4.92 |
| | PM | 2.89 | 4.93 |

*Photosensitive material was processed without running.

In comparative Procedure 7A, Dmax decreased to 59% of the initial value (41% lowering) on the fifth day. When Procedure 7A was applied to printing paper dot exposure, it became useless on the second day. In inventive Procedure 7B, a long-term running operation maintained stable performance because the increase of Dmax was little.

The present invention allows processing solutions, especially developer and fixer to maintain their processing ability optimum. The life of an anion exchange membrane is extended.

Although some preferred embodiments have been described, many modifications and variations may be made thereto in the light of the above teachings. It is therefore to be understood that within the scope of the appended claims, the invention may be practiced otherwise than as specifically described.

We claim:

1. An apparatus for processing a photographic silver halide photosensitive material after exposure, comprising a tank having disposed therein an anion exchange membrane and a diaphragm impermeable to anions excluding at least $OH^-$, said tank being charged with a processing solution in contact with a first electrolyte solution through said anion exchange membrane and in contact with a second electrolyte solution through said diaphragm, a first anode immersed in said first electrolyte solution, a second anode immersed in said second electrolyte solution, and a cathode immersed in said processing solution, and means for conducting electricity between said anodes and said cathode.

2. The apparatus of claim 1 wherein said conducting means includes a control for independently conducting electricity between a selected pair of electrodes.

3. An apparatus for processing a photographic silver halide photosensitive material after exposure, comprising a tank having disposed therein an anion exchange membrane and a diaphragm impermeable to anions excluding at least $OH^-$, said tank being charged with a processing solution in contact with a first electrolyte solution through said anion exchange membrane and in contact with a second electrolyte solution through said diaphragm, an anode immersed in said first electrolyte solution, a first cathode immersed in said processing solution, and a second cathode immersed in said second electrolyte solution, and means for conducting electricity between said anode and said cathodes.

4. The apparatus of claim 3 wherein said conducting means includes a control for independently conducting electricity between a selected pair of electrodes.

5. An automatic developing machine for processing a photographic silver halide photosensitive material after exposure, including at least a processing vessel filled with a processing solution with which the photosensitive material is processed, said machine being combined with the apparatus of any one of claims 1 to 4, said vessel and said tank being coupled through a conduit for communication of the processing solution therebetween.

6. An automatic developing machine for processing a photographic silver halide photosensitive material after exposure, including at least a processing vessel filled with a processing solution with which the photosensitive material is processed, said machine having incorporated therein the apparatus of any one of claims 1 to 4 such that the processing solution in said tank is in fluid communication with the processing solution in the processing vessel.

7. A photographic processing method using the apparatus of claim 1 comprising the step of:

conducting electricity across at least one of a first combination of the first anode and the cathode and a second combination of the second anode and the cathode in response to processing of the photographic silver halide photosensitive material.

8. The method of claim 7 comprising the steps of:

conducting electricity between the first pair of electrodes in accordance with the quantity of photosensitive material processed, and conducting electricity between the second pair of electrodes in accordance with the elapsed time.

9. The method of claim 7 comprising the step of:

conducting electricity between the first and second pairs of electrodes in accordance with the quantity of photosensitive material processed.

10. A photographic processing method using the apparatus of claim 3 comprising the step of:

conducting electricity across at least one of a first combination of the anode and the first cathode and a second combination of the anode and the second cathode in response to processing of the photographic silver halide photosensitive material.

11. The method of claim 10 comprising the steps of:

conducting electricity between the second pair of electrodes primarily in accordance with the quantity of photosensitive material processed, and conducting electricity between the first pair of electrodes in accordance with the elapsed time and the quantity of photosensitive material processed.

* * * * *